United States Patent [19]

Goto et al.

[11] 4,315,189

[45] Feb. 9, 1982

[54] SUPPORT STRUCTURE FOR SHADOW MASK OF COLOR CATHODE RAY TUBE

[75] Inventors: Yasumasa Goto; Junichi Ozaki, both of Hyogo, Japan

[73] Assignee: Toshiba Corporation, Kawasaki, Japan

[21] Appl. No.: 104,775

[22] Filed: Dec. 18, 1979

[30] Foreign Application Priority Data

Feb. 14, 1979 [JP] Japan ..... 54-15066
Oct. 16, 1979 [JP] Japan ..... 54-132417

[51] Int. Cl.[3] ..... H01J 29/80

[52] U.S. Cl. ..... 313/405; 313/406; 313/407

[58] Field of Search ..... 313/404, 405, 406, 407

[56] References Cited

U.S. PATENT DOCUMENTS

| | | | |
|---|---|---|---|
| 3,330,980 | 7/1967 | Shrader | 313/405 |
| 3,399,319 | 8/1968 | Schwartz et al. | 313/405 |
| 3,487,251 | 12/1969 | Barten et al. | 313/406 |
| 3,524,973 | 8/1970 | Rigdon | 313/405 |
| 3,573,527 | 4/1971 | Hafkenscheid et al. | 313/405 |
| 3,700,948 | 10/1972 | Palac | 313/405 |
| 3,823,336 | 7/1974 | Nakamura et al. | 313/405 |

FOREIGN PATENT DOCUMENTS

| | | | |
|---|---|---|---|
| 2352628 | 4/1975 | Fed. Rep. of Germany | 313/405 |
| 2352629 | 4/1975 | Fed. Rep. of Germany | 313/405 |
| 2359844 | 6/1975 | Fed. Rep. of Germany | 313/405 |
| 47-3506 | 1/1972 | Japan | 313/405 |

*Primary Examiner*—Stanley T. Krawczewicz
*Attorney, Agent, or Firm*—Schuyler, Banner, Birch, McKie & Beckett

[57] ABSTRACT

In a color cathode ray tube having a glass envelope and panel, a shadow mask is positioned adjacent a phosphor screen in the panel. Supporting members secure the shadow mask to the panel. These supporting members are responsive to the heat generated in the shadow mask to compensate for the thermal expansion of the shadow mask by displacing the shadow mask toward the phosphor screen. The supporting members each comprise a pair of plate-like segments spaced apart along at least a portion of their lengths. The plate-like segments are formed of metals having different coefficients of thermal expansion. No bi-metallic elements are used to form the plate-like segments of the supporting members.

8 Claims, 11 Drawing Figures

SUPPORT STRUCTURE FOR SHADOW MASK OF COLOR CATHODE RAY TUBE

BACKGROUND OF THE INVENTION

This invention relates to a color cathode ray tube, more particularly to the supporting structure for the shadow mask within the tube.

In a color cathode ray tube having a shadow mask, the shadow mask conventionally is secured to supporting studs in the glass envelope of the tube by supporting members. The supporting members usually comprise bimetal segments which compensate for the thermal expansion of the shadow mask during electron beam bombardment. In order for the electron beam to follow the right path toward the phosphor screen of the tube, the shadow mask must be displaced slightly toward the phosphor screen to compensate for thermal expansion of the shadow mask. The bi-metal segments, which conventionally consist of two metal layers secured on each other, displace the shadow mask toward the phosphor screen as described in U.S. Pat. No. 3,330,980 issued to Shrader on July 11, 1967. Each of the bi-metal segments is formed in two layers, one of which is a metal plate having a uniformly low coefficient of thermal expansion and the other of which is a metal plate having a high coefficient of thermal expansion. These bi-metal segments are carefully positioned to result in movement of the shadow mask toward the phosphor screen upon thermal expansion. However, the cost of manufacturing bi-metal segments is very high because these bi-metal segments must meet precise specifications to result in uniform and consistent operation.

Various improvements have been made in the bi-metal segments which support the shadow mask. For example, in U.S. Pat. No. 3,573,527 issued to Hafkenscheid et al on Apr. 6, 1971, a lateral bi-metal supporting member is shown having bi-metal segments connected together on the narrow side. However, welding the different metal segments along their narrow sides is still difficult and it is difficult to select the proper combination of these metals. Furthermore, because the metal segments are very thin and are welded together by seam welding, the bi-metal supporting member is not suitable to support a heavy shadow mask within a large size color cathode ray tube.

Similarly, other attempts to improve the structure of the bi-metal supporting members have not overcome the above mentioned disadvantages. In U.S. Pat. No. 3,823,336 issued to Nakamura et al on July 9, 1974, a pair of parallel bi-metal strips are shown to support the shadow mask. Although these strips will support a heavy shadow mask, these strips are similar to the bi-metal segments in the Shrader patent and suffer the same disadvantage of high manufacturing cost. Finally, in U.S. Pat. Nos. 3,399,319 and 3,487,251 issued to Schwartz et al and Barten et al, respectively, parallel strips having the same coefficient of thermal expansion are used to support the shadow mask. While these parallel strips overcome some of the disadvantages of manufacturing discussed above, they do not provide effective and precise control of the movement of the shadow mask during thermal expansion.

SUMMARY OF THE INVENTION

It is an object of this invention to provide a color cathode ray tube having supporting members which rigidly secure the shadow mask and compensate for the thermal expansion of the shadow mask. It is another object of this invention to provide a color cathode ray tube having supporting members which can be easily manufactured.

In accordance with the invention, a color cathode ray tube comprises a glass envelope including a panel on which a phosphor screen is disposed. A shadow mask is situated adjacent the phosphor screen. The shadow mask comprises a mask frame and an apertured mask mounted across the mask frame. A plurality of supporting members support the shadow mask within the glass envelope, each of the supporting members having one end secured to the mask frame and the other end secured to a supporting stud in the panel. Each of the supporting members comprises a pair of plate-like segments which are spaced apart and adjacent to each other along at least a portion of their lengths. One of the plate-like segments has a higher coefficient of thermal expansion than the other plate-like segment. However, the plate-like segments are not bi-metallic. The plate-like segments are formed of different metals, i.e., one plate-like segment is formed of one metal and the other plate-like segment is formed of another metal. Thus, the supporting member is responsive to heat to bend in a direction lateral to the plate-like segments.

DETAILED DESCRIPTION OF THE PREFERRED EMBODIMENT

Figure 1:
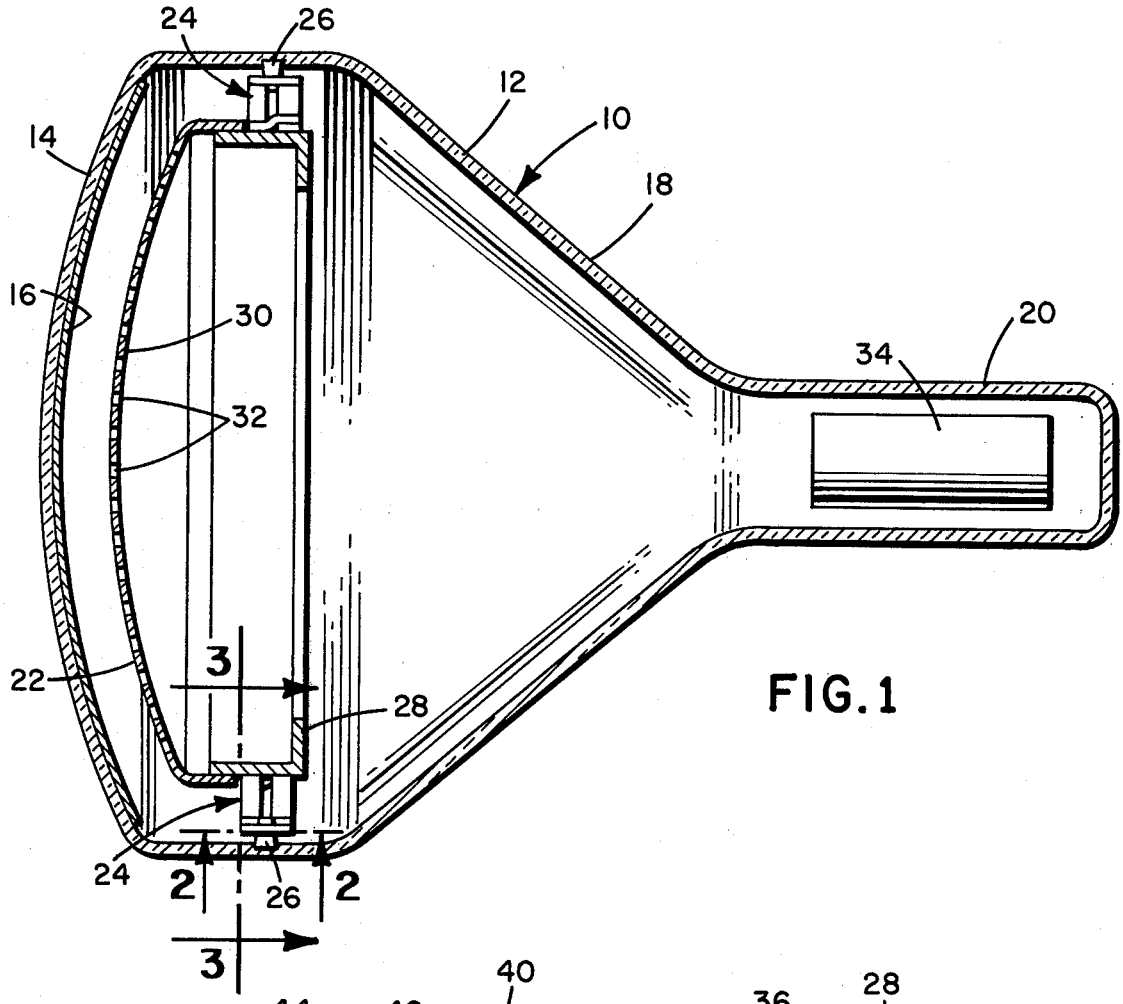
FIG. 1 is a vertical sectional view of a color cathode ray tube in accordance with the invention.

Referring to FIG. 1, a shadow mask type color cathode ray tube 10 is provided with an evacuated glass envelope 12. The envelope 12 comprises a panel 14 on which the phosphor screen 16 is disposed, a funnel 18 extending from the panel, and a neck portion 20 extending from the funnel. A shadow mask (i.e., a color selecting electrode) 22 is secured adjacent the phosphor screen 16 by supporting members 24 and supporting studs 26 which are formed in the internal side wall of the panel 14. The shadow mask 22 comprises a mask frame 28 and an apertured mask 30 mounted across the mask frame 28. The apertured mask 30 has apertures 32 aligned with the phosphor dots or stripes of the screen 16, respectively. Each of the apertures 32 passes electron beams from an electron gun 34 mounted within the neck portion 20. The apertures provide accurate paths for the electron beams directed towards the screen 16.

Figure 2:
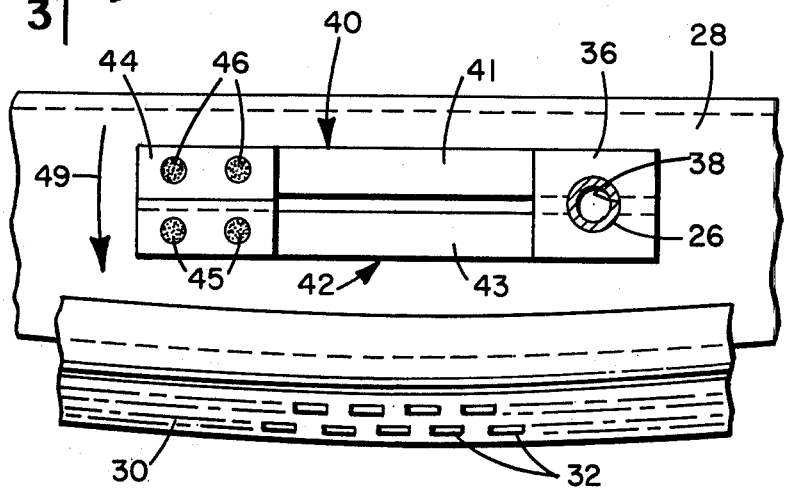
FIG. 2 is a fragmentary plan view taken along the line 2—2 of FIG. 1.
Figure 3:
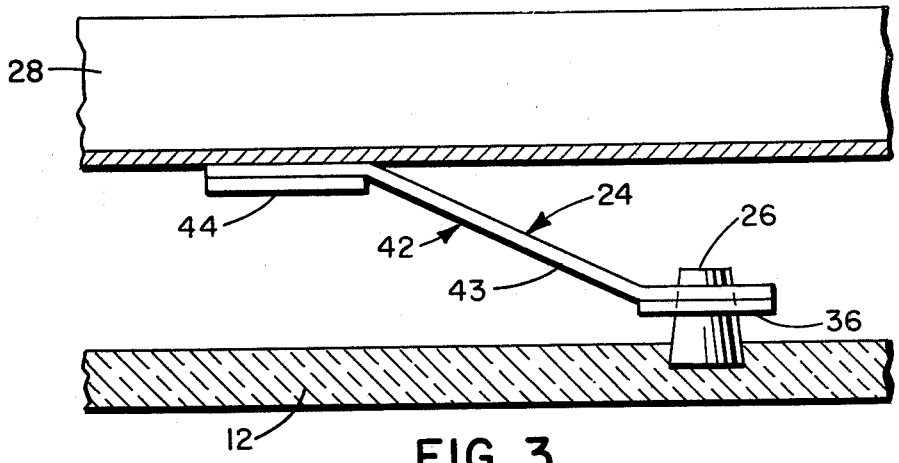
FIG. 3 is a sectional view taken along the line 3—3 of FIG. 1.
Figure 4:
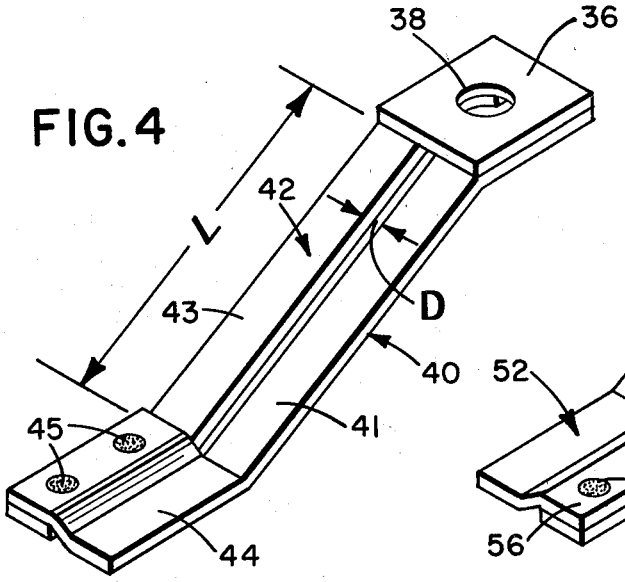
FIG. 4 is a perspective view of the supporting member of FIG. 1 of the invention.

As shown in FIGS. 2-4, supporting member 24 includes a support plate 36 having an opening 38 which engages the supporting stud 26 in the panel 14. The supporting member 24 also includes a resilient first plate-like segment 40 of low thermal expansion metal and a resilient second plate-like segment 42 of relatively high thermal expansion metal. The first plate-like segment 40 may be made of Ivar (64% Fe, 36% Ni) and the second plate-like segment 42 may be made of stainless steel (79% Fe, 13% Cr, 8% Ni). These segments 40 and 42 are welded at one end to the support plate 36 and extend therefrom at an angle. The first plate-like segment 40 has a lug 44 at the other end which is bent up and fastened to the top of the other end of the second plate-like segment 42 by spat welds 45. Support plate 36 and lug 44 are parallel to each other. Intermediate inclined portions of segments 40 and 42, respectively, are substantially parallel and aligned in substantially the same plane and are spaced apart from support plate 36 to lug 44. The lug 44 of the supporting member 24 then is welded to the mask frame 28 by spot welds 46. In operation, when heat is conducted to the supporting member 24 through the apertured mask 30 and the mask frame 28, the supporting member 24 deforms and flexes, and the mask frame 28 shifts in the direction of arrow 49 about the fulcrum corresponding to supporting stud 16. As a result, the shadow mask 22 is displaced towards the phosphor screen 16 to prevent the electron beam from mislanding on the screen. The supporting member 24 thereby compensates for the thermal expansion of the shadow mask 22.

The supporting member 24 provides the same thermal compensation as conventional bi-metal supporting members without using bi-metallic elements. Consequently, since the supporting member 24 is not limited in thickness, it can rigidly secure the shadow mask 22 to the panel 14 at constant temperature, the supporting member 24 is rigid in the direction of the axis of the color cathode ray tube and resilient in a direction normal to the axis. The supporting member 24 may be fitted on the mask frame 28 so that the larger surfaces of the plate-like segments 40 and 42 are directed along the axis of the color cathode ray tube. The amount of flexure of the supporting member 24 in response to heat can be adjusted by varying the length L and the distance D between the portions 41 and 43 of plate-like segments 40 and 42.

In general, the shadow mask of the color cathode ray tube needs to be displaced by approximately 0.01 mm to 0.1 mm in response to heat. Therefore the length L can be selected within the range of 10 mm to 50 mm according to the size of the tube. The distance D also can be adjusted to adjust the amount of displacement of the shadow mask. When the distance D along the length L is constant, the supporting member 24 is simple and easy to manufacture. On the other hand, by altering the distance D along the length L, the supporting member 24 can be made to compensate more precisely the thermal expansion of the shadow mask.

Figure 5:
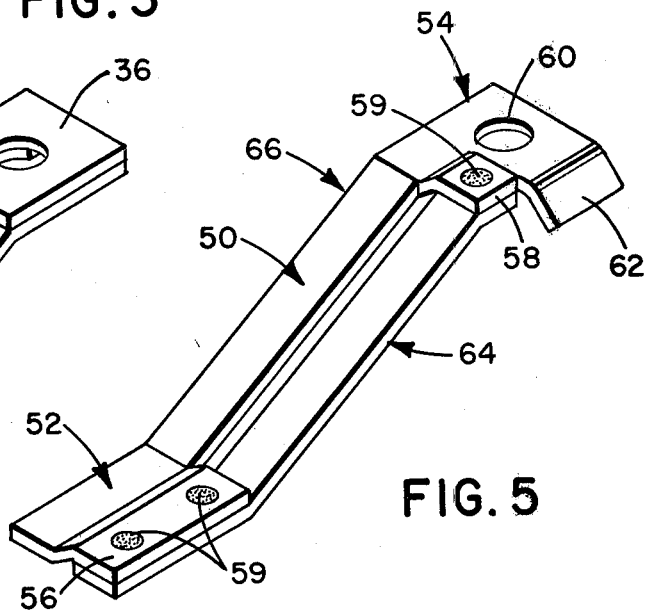
FIG. 5 is a perspective view of a second embodiment of the supporting member of the invention.

Another embodiment of the invention is shown in FIG. 5. A first resilient plate-like segment 50 having a low coefficient of thermal expansion comprises lugs 52 and 54 which extend at both ends of the segment along the sides thereof. One of lugs 52 has a raised portion 56, and the other lug 54 has a raised portion 58, an opening 60 and an inclined tube-like portion 62 for gripping. The ends of a second resilient plate-like segment 64 having a relatively high coefficient of thermal expansion are welded to the raised portions 56 and 58 by spot welds 59. Consequently, the supporting member 66 is easily assembled by attachment of two leaf spring members (i.e., the segments 50 and 64).

Figure 6:
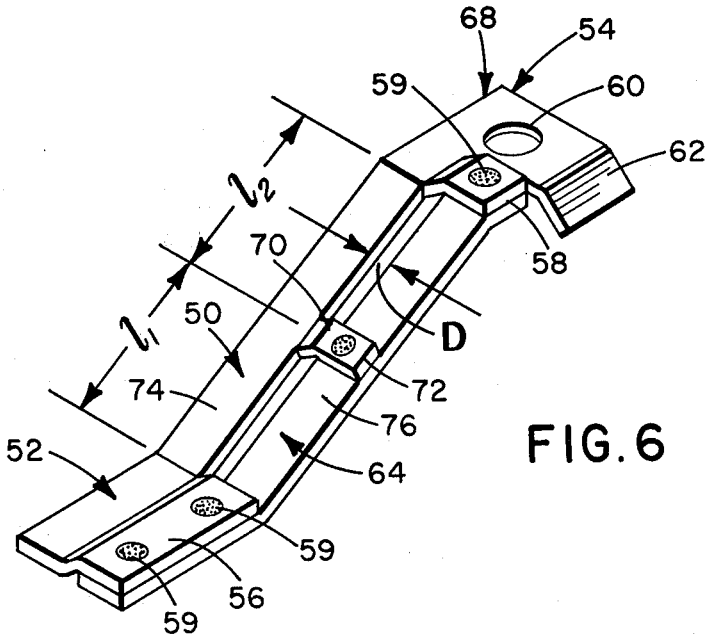
FIG. 6 is a perspective view of a modification of the second embodiment of the supporting member of the invention.

A further modified supporting member 68 is shown in FIG. 6, wherein like reference numerals designate corresponding parts in FIG. 5. A first plate-like segment 50 comprises a projection 70 positioned at the intermediate portion between both ends thereof. The end 72 of projection 70 is bent up to overlie and connect by welding to parallel segment 64. The projection 70 interconnects the intermediate portions 74 and 76 of the segments 50 and 64. As a result, the mechanical strength of the intermediate portions 74 and 76 is increased. This supporting member 68 has complex flexure stress as compared to the structure in FIG. 5. The desired amount of displacement is a function of the length $l_1$ and $l_2$ and the distance D.

Figure 7:
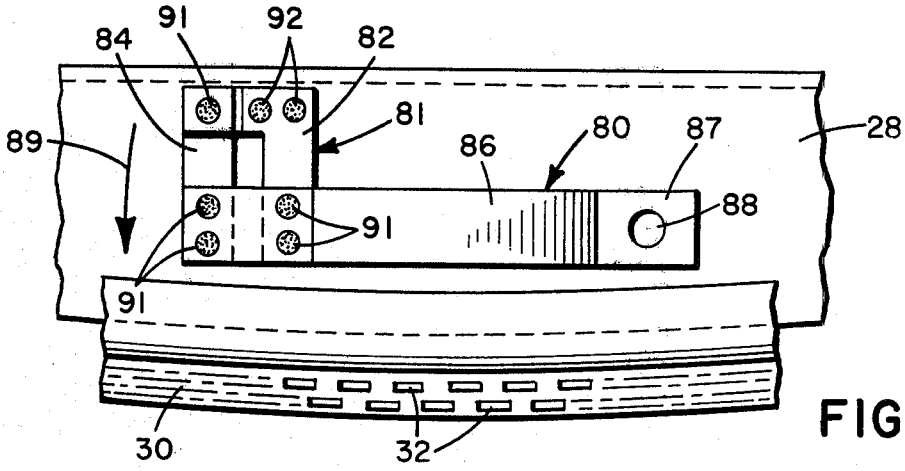
FIG. 7 is a fragmentary plan view of a third embodiment of the invention.
Figure 8:
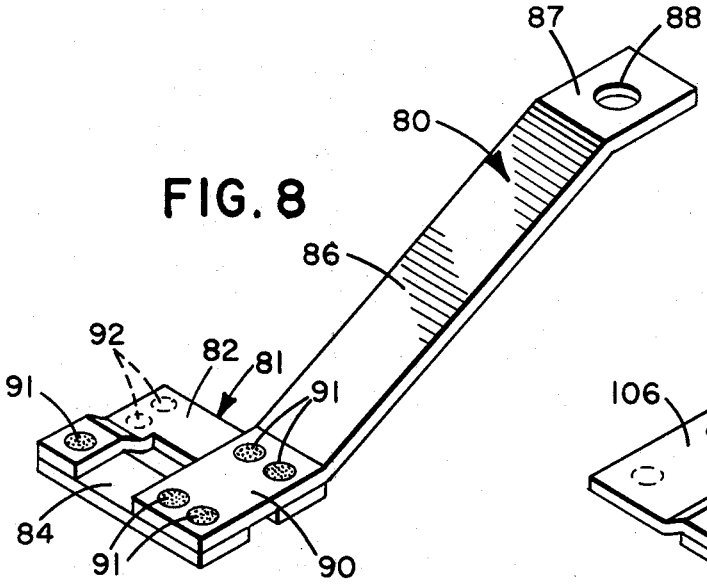
FIG. 8 is a perspective view of the supporting member of the third embodiment shown in FIG. 7.

Yet another embodiment of the invention is shown in FIGS. 7 and 8. A supporting member 80 comprises three parts including a first L-shaped plate-like segment 81 having a low coefficient of thermal expansion, a second strip plate-like segment 84 having a relatively higher coefficient of thermal expansion and a leaf spring member 86. The end portion 82 of segment 81 is welded to connecting portion 90 of member 80, as is one end of segment 84. The leaf spring member 86 has an opening 88 in one end 87 and a connecting portion 90 for connection with the segments 81 and 84 at the other end. The leaf spring member 86 is inclined at an angle relative to the connecting portion 90 and end 87. The portion 82 of segment 81 and segment 84 are parallel and spaced apart and are connected integrally with each other at both ends by spot welds 91. The supporting member 80 is welded to the mask frame 28 by spot welding at weld points 92. The mask frame 28 supports the apertured mask 30 having apertures 32.

In operation, the apertured mask 30 and the mask frame 28 thermally expand due to electron beam bombardment of the mask 30 and thermal conductivity of heat to the mask frame 28. When the heat is conducted to the supporting member 80, the supporting member 80 bends about the fulcrum corresponding to opening 88 in a plane along the axis of color cathode ray tube towards the screen 16. The arrow 89 indicates the bending of the supporting member 80 about the fulcrum 88. As a result, the supporting member 80 compensates for the thermal expansion of the shadow mask so that the electron beam accurately strikes the phosphor screen through the shadow mask 30.

In supporting member 80, the displacement due to thermal expansion of the segments 82 and 84 is greater relative to the pivot point 88 because of the lever arm action of the leaf spring member 86 and the fulcrum corresponding supporting stud 26. The amount of displacement also can be controlled extensively by changing the length of the leaf spring member 86 and the distance between the plate-like members 82 and 84.

Figure 9:
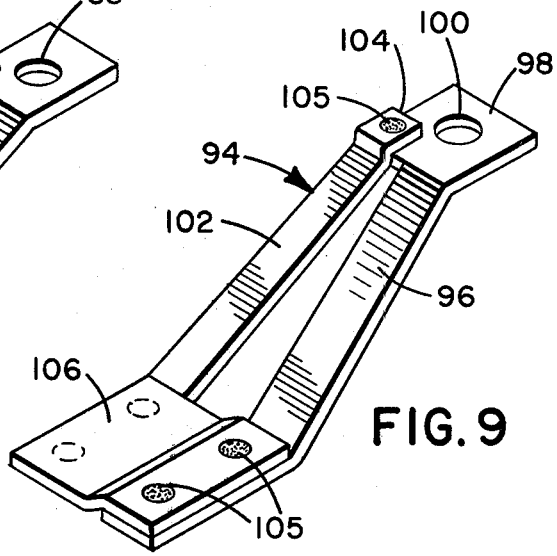
FIG. 9 is a perspective view of a fourth embodiment of the supporting member of the invention.

FIG. 9 shows a modified supporting member 94 which may be used in place of the aforementioned embodiments. The supporting member 94 comprises a plate-like segment 96 which has a support plate 98 with an opening 100 at one end and a plate-like segment 102 having a raised portion 104 at the end adjacent plate 98, and a lug 106 at the other end. Support plate 98 is parallel to portion 106 and displaced upwardly by inclined segments 96 and 102. The segments 96 and 102 are connected to each other at the raised portions on both ends by spot welds 105. The plate-like segment 96 has a higher coefficient of thermal expansion than the plate-like segment 102.

Figure 10:
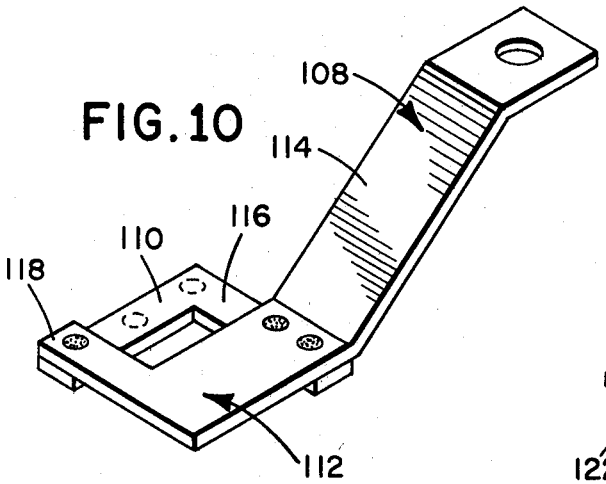
FIG. 10 is a perspective view of a fifth embodiment of the supporting member of the invention.

FIG. 10 shows a further embodiment of the supporting member 108. A first segment 110 having a low coefficient of thermal expansion is L-shaped. A second segment 112 having a high coefficient of thermal expansion is also L-shaped and one of the arms thereof extends at an angle upwardly to form a leaf spring member 114 which is bent parallel to segment 112 at its end 115. These segments 110 and 112 are connected to each other so that the arms 116 and 118 are parallel to each other and the leaf spring arm 114 is inclined at an angle to the arms 116 and 118. Since the supporting member 108 has no offset portions such as 104 and 106, it is very easy to manufacture the member 108. Also the member 108 does not twist or deform because of the relatively wide surface thereof.

Figure 11:
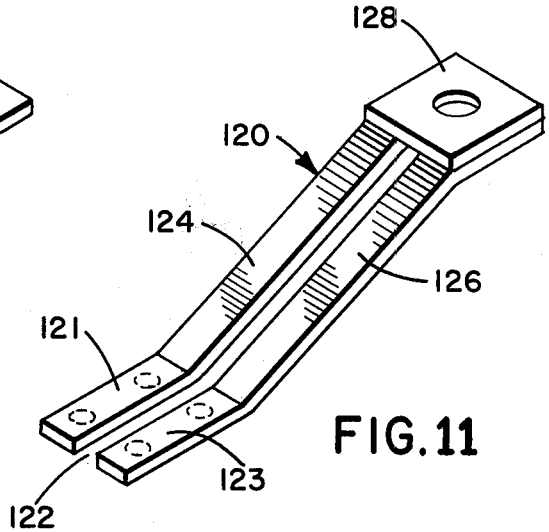
FIG. 11 is a perspective view of a sixth embodiment of the supporting member of the invention.

A modified supporting member 120 is shown in FIG. 11 with an open end 122 at one end. Two strip segments 124 and 126, which have different coefficients of thermal expansion, are connected at the other end to a support plate 128. The ends 121 and 123 are welded directly on the mask frame 28. The supporting member 120 can also be fastened to the mask frame 28 by means of another metal plate. Finally the supporting member 120, as well as all the other embodiments described above, can be fastened to the mask frame 28 at an angle to the edge of the mask frame.

Although illustrative embodiments of the invention have been described in detail with reference to the accompanying drawings, it is to be understood that the invention is not limited to those precise embodiments and that various changes and modifications may be effected therein by one skilled in the art without departing from the scope or spirit of the invention.

We claim:

1. A color cathode ray tube comprising:

an envelope including a panel;

a phosphor screen disposed on said panel;

a shadow mask adjacent said phosphor screen, said shadow mask including a mask frame and an apertured mask mounted across said mask frame;

a plurality of supporting members for supporting said shadow mask within said envelope, each of said supporting members having one end secured to said panel and the other end fastened to said mask frame to support said shadow mask, each of said supporting members comprising a pair of plate-like segments spaced apart along at least a portion of their length and connected integrally with each other at both ends, one of said plate-like segments being formed of a metal having a higher coefficient of thermal expansion than the metal forming the other said plate-like segments, said plate-like segments being responsive to heat to bend in a direction lateral to said plate-like segments to displace said shadow mask toward said phosphor screen.

2. The color cathode ray tube of claim 1 wherein at least one of said pair of plate-like segments includes an extended plate spring member secured to said panel.

3. The color cathode ray tube of claim 1 wherein each of said supporting members further comprises a plate spring member secured at one end to one of said pair of plate-like segments and fastened at the other end to said panel.

4. The color cathode ray tube of claim 1 wherein said one end of each of said supporting members comprises an opening engaging a supporting stud on said panel.

5. The color cathode ray tube of claim 1 wherein one of said pair of plate-like segments has a depressed portion at one end and the other of said pair of plate-like segments is connected to said depressed portion.

6. The color cathode ray tube of claim 1 wherein said pair of plate-like segments have an integral cross part between both ends thereof.

7. The color cathode ray tube of claim 1 wherein one of said pair of plate-like segments is L-shaped.

8. The color cathode ray tube of claim 1 wherein said plate-like segments are parallel to each other in the same plane.

* * * * *